United States Patent [19]

Ries et al.

[11] 3,981,798

[45] Sept. 21, 1976

[54] LIQUID/LIQUID EXTRACTION USING CERTAIN ETHERS AND ESTERS

[75] Inventors: Donald G. Ries; David G. Braithwaite, both of Brookhaven, Miss.

[73] Assignee: Nalco Chemical Company, Oak Brook, Ill.

[22] Filed: May 5, 1975

[21] Appl. No.: 574,209

Related U.S. Application Data

[63] Continuation-in-part of Ser. No. 501,519, Aug. 29, 1974, abandoned.

[52] U.S. Cl. ..... 208/323; 208/329; 208/333; 208/334

[51] Int. Cl.[2] ..... C10G 21/16

[58] Field of Search ..... 208/329, 333, 334, 323; 260/674 SE

[56] References Cited

UNITED STATES PATENTS

| | | | |
|---|---|---|---|
| 2,212,107 | 8/1940 | Yabroff | 260/674 SE |
| 2,840,620 | 6/1958 | Gerhold et al. | 260/674 SE |
| 3,583,906 | 6/1971 | Basila et al. | 208/331 |

FOREIGN PATENTS OR APPLICATIONS

| | | | |
|---|---|---|---|
| 324,350 | 1/1930 | United Kingdom | 208/329 |

*Primary Examiner*—Herbert Levine
*Attorney, Agent, or Firm*—John G. Premo; Robert A. Miller; Barry W. Sufrin

[57] ABSTRACT

A process for the liquid/liquid extraction of aromatic hydrocarbons from organic solvent mixtures containing aromatic and aliphatic hydrocarbons by the use of certain ethers and esters as extractants is disclosed.

3 Claims, No Drawings

LIQUID/LIQUID EXTRACTION USING CERTAIN ETHERS AND ESTERS

This Application is a continuation-in-part of our copending Patent Application, Ser. No. 501,519 filed Aug. 29, 1974 now abandoned.

The separation of aromatic hydrocarbons from aliphatic hydrocarbons has become increasingly important in recent years. This is due to the need for recycling solvents by recovering aromatics from waste solvents and the need for removing aromatics from process streams. One common method of separating aromatics from aliphatic hydrocarbons is distillation. However, this technique, while well known, does not perform satisfactorily due to the similar boiling points of aromatic and long chain aliphatic hydrocarbons. It would, therefore, be an advantage to the art if aromatic hydrocarbons could be extracted from solvent mixtures containing aliphatic hydrocarbons by a simple, inexpensive technique.

Liquid/liquid extraction is a well-known technique. In this process, an imiscible liquid, the extractant, is mixed with a liquid containing a material which is to be extracted. Following mixing, the two liquids are separated and the desired compound is removed from the extractant by well known means. In the method of our invention, an organic solvent system containing both aromatic and aliphatic hydrocarbons is contacted with an imiscible extractant. The solvent mixture is then mixed with the extractant, the extractant separated, and the aromatics removed from the extractant.

The extractants used in our invention are mono-methylether of glycerine, mono-ethylether of glycerine and a mixture of glycerine monoacetate and glycerine diacetate. These compounds are inexpensive and are made by well known techniques. These extractants are imiscible with aliphatic organic liquids and have a sufficiently high boiling point to allow removal of the aromatics by distillation or similar means.

OBJECTS

It is therefore an object of our invention to provide to the art a new and useful method for the recovery of aromatic hydrocarbons from organic solvent systems containing aromatic and aliphatic hydrocarbons.

A further object of our invention is to provide to the art an inexpensive method for the recovery of aromatic hydrocarbons from organic solvent mixtures containing both aromatic and aliphatic hydrocarbons through the use of mono-methylether of glycerine, mono-ethylether of glycerine or a mixture of glycerine monoacetate and glycerine diacetate as a liquid/liquid extraction agent.

A still further object of our invention involves the use of mono-methylether of glycerine, mono-ethylether of glycerine or a mixture of glycerine monoacetate and glycerine diacetate as the extractant agent in a liquid/liquid extraction process for the recovery of aromatic hydrocarbons from organic solvent systems containing both aromatic and aliphatic hydrocarbons.

THE EXTRACTANTS

Mono-methylether of glycerine, mono-ethylether of glycerine and a mixture of glycerine monoacetate and glycerine diacetate are used as the extractants in our invention. They are imiscible with organic solvent systems and are generally high-boiling. Of these extractants, a mixture of glycerine monoacetate and glycerine diacetate is preferred.

THE ORGANIC SOLVENT SYSTEMS

The organic solvent systems for which our invention is useful may contain aromatics in a concentration as high as 50% by volume or as low as parts per million quantities. Generally, the volume ratio of aliphatic hydrocarbons to aromatic hydrocarbons will be in the range of 1000:.5 to 0.5:1. Preferably, the volume ratio of aliphatic hydrocarbons to aromatic hydrocarbons will be in the range of 500:0.5 to 1.0:1.0. The most preferred volume ratio of aliphatic hydrocarbons to aromatic hydrocarbons will be in the range of 250:0.5 to 1.0:1.0. The organic solvent systems contemplated should furthermore be fluid at the temperature used for the extraction and may contain many different identifiable organic compounds, both aliphatic and aromatic.

THE METHOD OF EXTRACTION

In the process of our invention, mono-methylether of glycerine, mono-ethylether of glycerine or a mixture of glycerine monoacetate and glycerine diacetate is first placed in contact with the organic solvent system from which it is desired to remove the aromatic hydrocarbons. The two imiscible liquids are then mixed for a time sufficient to cause good contact between the two imiscible layers at either ambient or elevated temperatures. After sufficient mixing, the two imiscible layers are allowed to reform.

The bottom extractant layer containing mono-methylether of glycerine, mono-ethylether of glycerine or a mixture of glycerine monoacetate and glycerine diacetate is then drawn off or separated from the upper organic layer. The aromatic compounds contained in the extractant may then be recovered by well known means.

The ratio of the mono-methylether of glycerine, mono-ethylether of glycerine or a mixture of glycerine monoacetate and glycerine diacetate to the organic solvent will vary, but is usually within the range of 1:10 to 10:1 by volume. The time of mixing the extractant with the organic solvent system to be extracted will vary according to the composition of the organic liquid, the ratio of the extractant to the organic phase, and the temperature. The time of mixing should be long enough to ensure contact by the extractant with all of the aromatic compounds contained in the organic layer. The mixing procedure used should provide sufficient turbulence to adequately disperse both phases, preferably temporarily forming an unstable emulsion of the extractant and the organic solvent mixture.

Once the extractant layer has been recovered, the aromatic hydrocarbons contained within it may be separated by distillation or by other means. If desired, the aromatic hydrocarbon enriched extractant may repeatedly be mixed with a "fresh" batch of the organic solvent mixture prior to removing the aromatic hydrocarbons. This will enrich the aromatic content of the extractant and reduce the aliphatic content.

The extractant may be distilled after the first or any subsequent extraction to recover the aromatic compounds contained within it. The amount of aliphatic hydrocarbons present in the extractant will be low as compared to the ratio of aliphatic to aromatic hydrocarbons present in the original organic solvent mixture being extracted. Therefore, distillation of the extractant will be much more efficient than distillation of the original organic solvent system would have been.

EXAMPLES

In order to better illustrate our invention, the following examples are presented:

2 ml. of 60:40 by volume hexane:toluene hydrocarbon mixture were contacted with 6.0 ml. of an extractant. After mixing the two imiscible layers well, the mixture was allowed to separate and the extractant formed the lower layer. Analyses were run on both the top (hexane) and the bottom (extractant) layers. The results showed substantial enrichment of the extractant by the aromatic compound and a corresponding decrease in aromatics in the hexane layer. The results are given below:

| Example | Extractant | Ratio:toluene/hexane (Hexane Phase) | Ratio:toluene/hexane (Extractant) |
|---|---|---|---|
| 1 | Mono-methylether of glycerine | .48 | 2.14 |
| 2 | Mono-ethylether of glycerine | .38 | 1.44 |
| 3 | Mixture of glycerine monoacetate (33%) and glycerine diacetate (67%) | 0.55 | 4.0 |

If desired, the aromatic hydrocarbon (toluene in this case) could be recovered from the extractant by distillation. Alternately, the extractant could be added to a "fresh organic solvent mixture" to further increase the aromatic content and this could be followed by removal of the aromatic compounds from the extractant.

We claim:

1. A process for the liquid/liquid extraction of aromatic hydrocarbons from organic solvent mixtures which comprises the steps of:

A. contacting the organic solvent mixture with an extractant selected from the group consisting of mono-methylether of glycerine, monoethylether of glycerine and a mixture of glycerine monoacetate and glycerine diacetate in a volume ratio to the solvent mixture of from 1:10 to 10:1;

B. mixing the extractant with the organic solvent mixture for a period of time necessary to extract substantially all of the aromatic hydrocarbons into the extractant;

C. separating the extractant containing aromatic hydrocarbons from the organic solvent mixture;

D. recovering the aromatic hydrocarbons from the extractant.

2. The process of claim 1 wherein the aromatic hydrocarbons contained in the extractant are recovered by distillation.

3. The process of claim 1 wherein the extractant is a mixture of glycerine monoacetate and glycerine diacetate in the ratio of 1:2.

* * * * *